US006601501B2

(12) United States Patent
Takai

(10) Patent No.: US 6,601,501 B2
(45) Date of Patent: Aug. 5, 2003

(54) PAPER DISCHARGING DEVICE OF SCREEN PRINTING MACHINE

(75) Inventor: Mitsuji Takai, Tokyo (JP)

(73) Assignee: Sakurai Graphic Systems Corporation, Tokyo (JP)

( * ) Notice: Subject to any disclaimer, the term of this patent is extended or adjusted under 35 U.S.C. 154(b) by 0 days.

(21) Appl. No.: 10/026,344

(22) Filed: Dec. 21, 2001

(65) Prior Publication Data

US 2002/0144611 A1 Oct. 10, 2002

(30) Foreign Application Priority Data

Apr. 10, 2001 (JP) ..... 2001-111832

(51) Int. Cl.[7] ..... B41F 15/08; B41F 15/18; B41L 13/00

(52) U.S. Cl. ..... 101/118; 101/409; 101/232; 101/246; 271/82

(58) Field of Search ..... 101/114, 116, 101/117, 118, 123, 126, 129, 232, 246, 407.1, 408, 409, 410; 271/287, 314, 82, 84, 85, 194, 196, 197

(56) References Cited

U.S. PATENT DOCUMENTS 4,509,422 A * 4/1985 Nagatani ..... 101/118

FOREIGN PATENT DOCUMENTS

| | | | |
|---|---|---|---|
| DE | 1 436 548 | * | 4/1969 |
| DE | 2 005 101 | * | 8/1971 |
| DE | 2 305 872 | * | 8/1973 |

* cited by examiner

*Primary Examiner*—Leslie J. Evanisko
(74) *Attorney, Agent, or Firm*—Patterson, Thuente, Skaar & Christensen, LLC

(57) ABSTRACT

A paper discharging apparatus, which is provided in a printing machine, for transferring sheets of paper having different thickness. The paper discharging apparatus has a first gripper unit fixed in a groove, which extends along the cylindrical surface of a printing cylinder, and a second gripper unit, which moves along a discharging rail. The second gripper unit has a gripper and a base to hold the sheet. The position of the base is adjusted in accordance with the thickness of the sheet. A relatively thin sheet of paper is held by the first gripper unit and a relatively thick sheet of paper is held by the second gripper unit.

10 Claims, 10 Drawing Sheets

PAPER DISCHARGING DEVICE OF SCREEN PRINTING MACHINE

BACKGROUND OF THE INVENTION

The present invention is related to a cylinder type screen printing machine, and more particularly, to a paper discharging apparatus for transferring a printed paper.

However, the conventional discharging apparatuses have the following shortcomings.

Relatively thin paper tend to stick to the screen. Since papers are transferred along the screen in the first conventional discharging apparatus, it is difficult to separate paper from the screen. Further, printing is interrupted when a paper sticks to the screen.

The second conventional discharging apparatus transfers relatively thick paper along the printing cylinder. However, thick paper is relatively rigidity. Thus, when paper is separated from the printing cylinder, the end of the paper located on the opposite side of the end held by the discharging gripper may damage a screen during printing.

BRIEF SUMMARY OF THE INVENTION

It is an object of the present invention to provide a paper discharging apparatus of a printing machine that is capable of discharging papers of various thickness.

To achieve the above object, the present invention provides a paper discharging apparatus of a screen printing machine. The screen printing machine includes a rotatable printing cylinder for guiding a printed sheet of paper to one of a first discharging position and a second discharging position. The paper discharging apparatus includes a first gripper unit for receiving the sheet at a predetermined holding position and transferring the sheet to the first discharging position. A first holding portion is defined in the first gripper unit to hold the sheet. A second gripper unit receives the sheet at the holding position and transfers the sheet to the second discharging position. The second gripper unit is adjacent to the first gripper unit at the holding position. A second holding portion is defined in the second gripper unit to hold the sheet. The position of the second holding portion is selectively shifted between a first position and a second position relative to the second gripper unit. The second holding portion is allowed to hold the sheet when the second holding portion is in the first position. The first holding portion is allowed to hold the sheet when the second holding portion is in the second position.

A further aspect of the present invention is a paper discharging apparatus provided in a screen printing machine to receiving a sheet transferred from an upstream location and transfer the sheet to one of a first tray and a second tray in accordance with the thickness of the sheet. The screen printing machine includes a printing cylinder reciprocally rotated between a print start position and a print end position. The paper discharging apparatus includes a first gripper unit fixed in a groove extending axially along a cylindrical surface of the printing cylinder. The first gripper unit receives the sheet when the printing cylinder is arranged at the print start position and releases the sheet when the printing cylinder is arranged at the print end position and the first gripper is adjacent to the first tray. A first holding portion is defined in the first gripper unit for holding the sheet. A second gripper unit moves in synchronism with the printing cylinder. The second gripper unit is arranged in the groove adjacent to the first gripper unit when the printing cylinder is in the print start position and arranged adjacent to the second tray to release the sheet when the printing cylinder is in the print end position. A stopper is provided in the second gripper unit and has a positioning surface. The positioning surface contacts a front end of the sheet to position the sheet. A second holding portion is defined in the second gripper unit to hold the sheet. The second holding portion includes a base selectively shifted between a first position and a second position relative to the second gripper unit. A gripper holds the sheet with the base. The positioning surface is downstream of the base and the gripper and the base hold the sheet when the base is in the first position. The positioning surface is upstream of the base and the first holding portion holds the sheet when the second holding portion is in the second position.

Other aspects and advantages of the present invention will become apparent from the following description, taken in conjunction with the accompanying drawings, illustrating by way of example the principles of the invention

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Hereinafter, a cylinder type screen printing machine 1 according to a preferred embodiment of the present invention will be described referring FIGS. 1 to 10.

In this specification, a sheet of paper, or sheet P, is transferring is a downstream direction.

Figure 1:
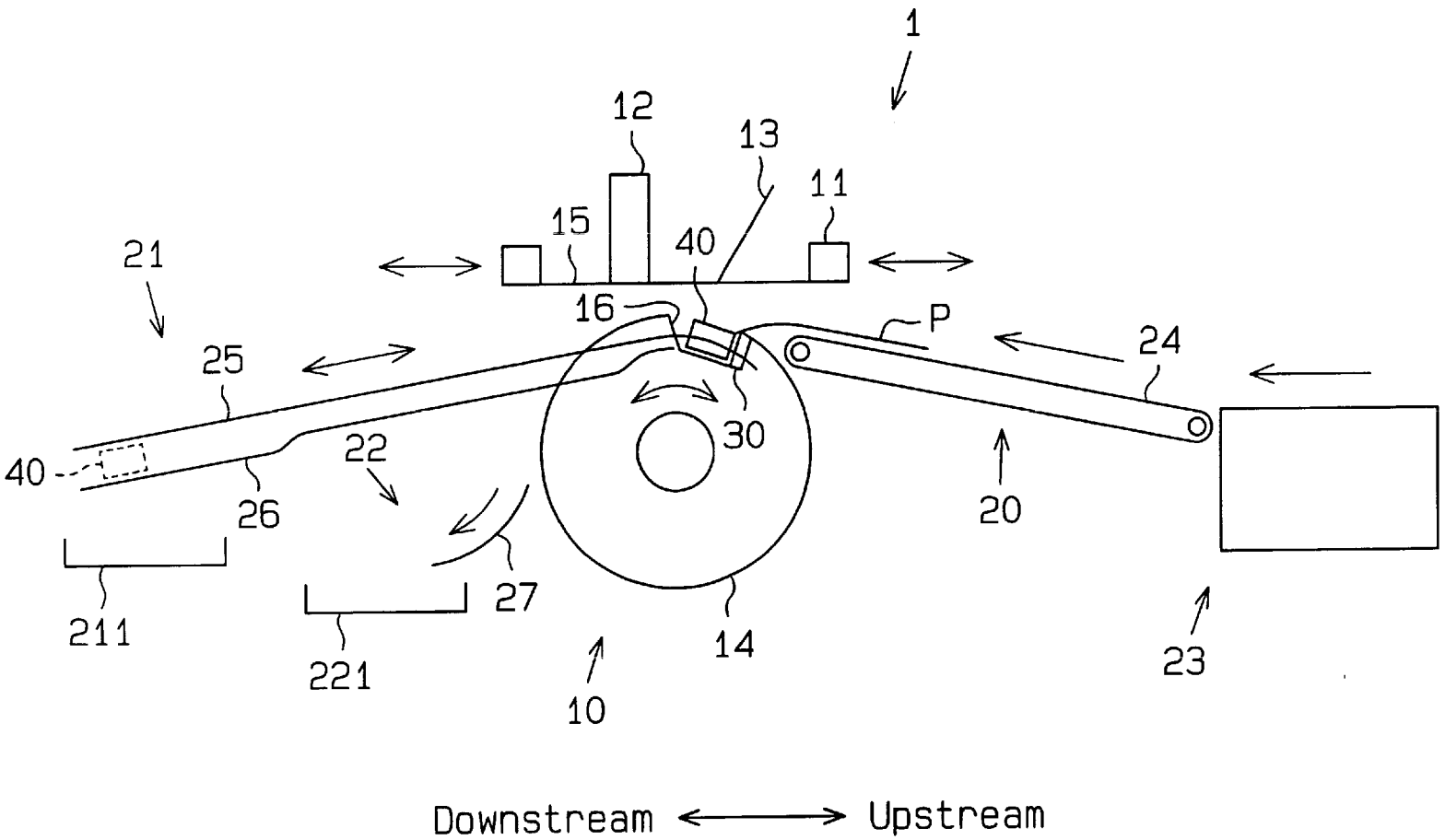
FIG. 1 is a schematic side view showing a printing machine according to a preferred embodiment of the present invention.

As shown in FIG. 1, the printing machine 1 has a printing mechanism 10 that is supported by a frame (not shown). A transferring device 20 is arranged upstream of the printing mechanism 10. A first discharging apparatus 21, which is used for relatively hard or thick paper, and a second discharging apparatus 22, which is used for relatively flexible or thin paper, are arranged downstream of the printing mechanism 10. A sheet feeder 23 is arranged upstream of the transferring device 20. A control device (not shown) synchronously drives the printing mechanism 10, the discharging apparatuses 21, 22, the transferring device 20, and the sheet feeder 23.

The printing mechanism 10 includes a screen frame 11, a squeegee 12, a doctor blade 13 and a printing cylinder 14. A screen support (not shown) supports the screen frame 11 so that the screen frame 11 is reciprocally movable in the horizontal direction. A printing plate 15 is fixed to the screen frame 11. The doctor blade 13 and the squeegee 12 are supported by the screen support so that they are vertically movable. The printing cylinder 14 is reciprocally rotated in the clockwise and counterclockwise directions in synchronism with the reciprocating movement of the screen frame 11.

A groove 16 extending in the axial direction of the printing cylinder 14 along the surface of the printing cylinder 14. A first gripper unit 30 for discharging thin papers and a second gripper unit 40 for discharging thick papers are accommodated in the groove 16. The first gripper unit 30 is fixed to one side surface (the right side surface in FIG. 1) of the groove 16. The second gripper unit 40 may be removed from the groove 16. In the preferred embodiment, the first gripper unit 30 and the second gripper unit 40 form the paper discharging apparatus. When the groove 16 is arranged at a predetermined printing start position, the sheet P is held by the first gripper unit 30 or the second gripper unit 40. When the groove 16 is arranged at a predetermined printing end position, the sheet is released from the first gripper unit 30 or the second gripper unit 40. That is, when the groove 16 is arranged in the predetermined printing start position, the paper discharging apparatus is arranged at a holding position, and when the groove 16 is arranged at the predetermined printing end position, the paper discharging apparatus is arranged at a discharging position.

The squeegee 12 presses the printing plate 15 against the printing cylinder 14. When the screen frame 11 moves horizontally, ink is applied to the sheet P by the squeegee 12 to perform printing. The doctor blade 13 is inclined relative to the printing plate 15 to wipes residual ink on the printing plate 15 after the printing.

A sheet feeder 23 holds a predetermined number of sheets P and supplies the sheets P one by one to the transferring device 20. The transferring device 20 includes a supplying belt 24. The belt 24 receives the sheets P from the sheet feeder 23 and supplies the sheets P to the printing mechanism 10 in synchronism with the rotation of the printing cylinder 14.

The second discharging apparatus 22 includes an arcuate stripper plate 27, which is adjacent to the printing cylinder 14. A thin paper tray 221 is arranged downstream of the stripper plate 27. When the groove 16, or the first gripper unit 30, reaches the predetermined first paper discharging position, the stripper plate 27 releases the sheet P from the printing cylinder 14. The stripper plate 27 guides the sheet P into the thin paper tray 221.

The first discharging apparatus 21 includes two paper discharging rails 25 and two guide rails 26. The second gripper unit 40 has two sliders 41 (refer to FIG. 3) that are supported by the two discharging rails 25. The second gripper unit 40 discharges the printed sheet P from the printing mechanism 10 in synchronism with the rotation of the printing cylinder 14 and transfers the sheet P along the discharging rails 25 to a thick paper tray 211.

The two guide rails 26 are arranged under the discharging rails 25 parallel to the two discharging rails 25. The second gripper unit 40 has two levers 42 that contact the upper surfaces of the two guide rails 26 (refer to FIG. 3). The second gripper unit 40 moves along the guide rails 26. The levers 42 are pivoted in accordance with the degree of contact with the guide rails 26.

The thick paper tray 211 is arranged at the downstream end of the discharging rails 25 and the guide rails 26. The second gripper unit 40 holds a relatively thick sheet P in the holding position and transfers the printed sheet P along the discharging rails 25. When the second gripper unit 40 reaches a predetermined position, the sheet P is released from the second gripper unit 40. The sheet P is moved along the discharging rails 25 and placed in the thick paper tray 211.

Figure 2:
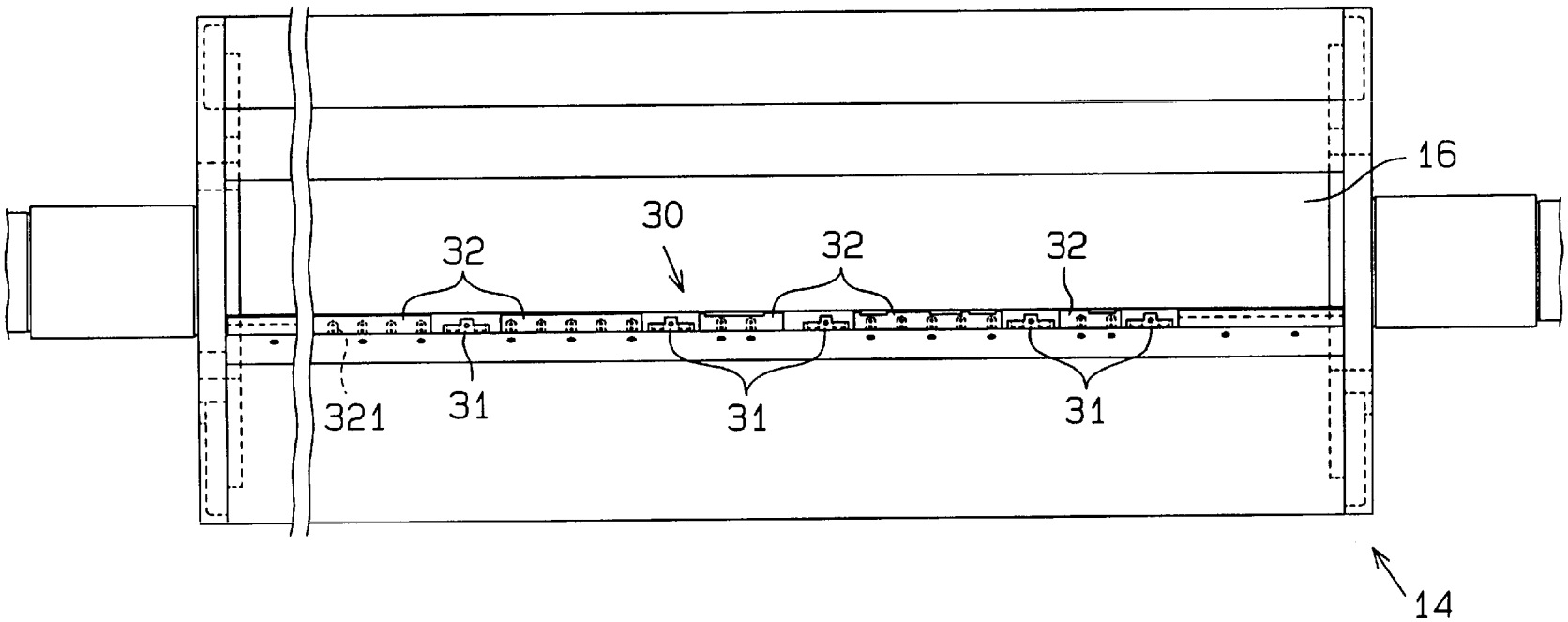
FIG. 2 is a plan view showing a printing cylinder and a first gripper unit of the printing machine of FIG. 1.

The first gripper unit 30 and the second gripper unit 40 will be explained in detail. As shown in FIG. 2, the first gripper unit 30 is fixed to one side surface of the groove 16. The first gripper unit 30 includes a plurality of first bases 31 and a plurality of rectangular suction members 32, which function as a first holding portion. The first bases 31 and the suction members 32 are arranged alternately. The first bases 31 and the suction members 32 are arranged throughout the groove 16 except for locations corresponding to the two axial ends of the first gripper unit 30.

Figure 4:
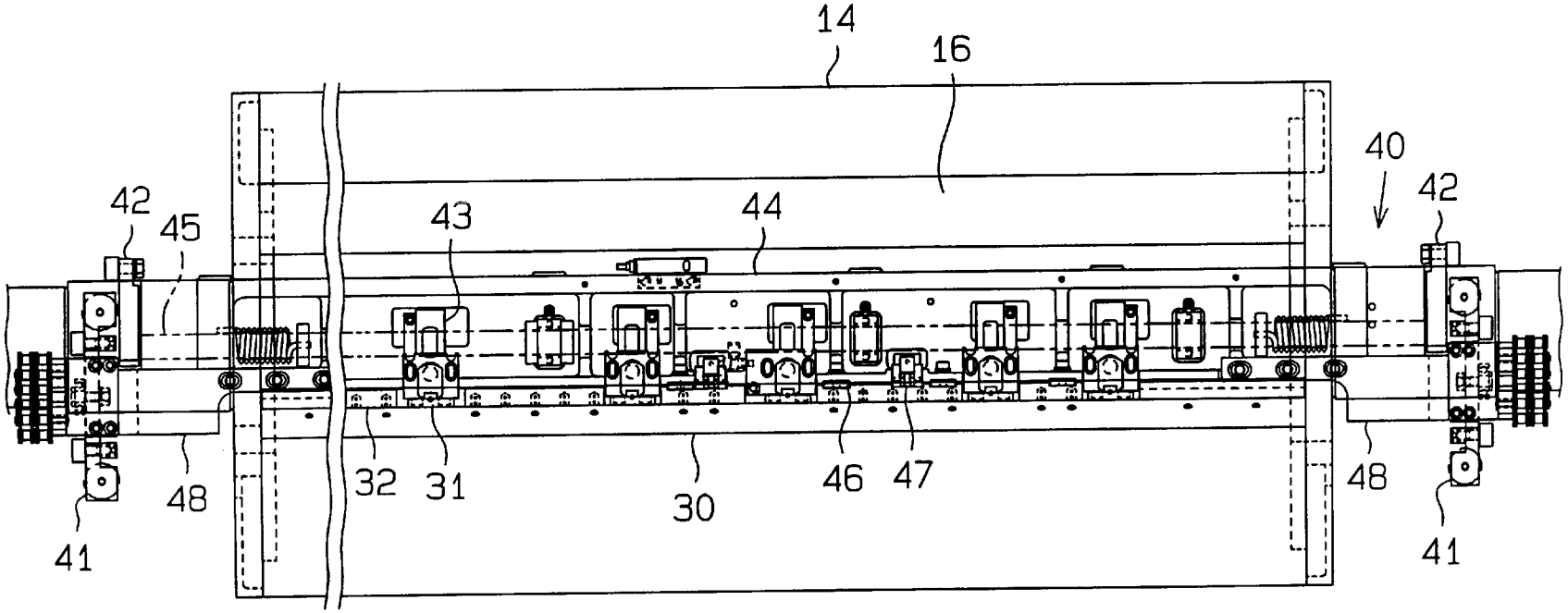
FIG. 4 is a plan view showing the second gripper unit arranged in a holding position.
Figure 5A:
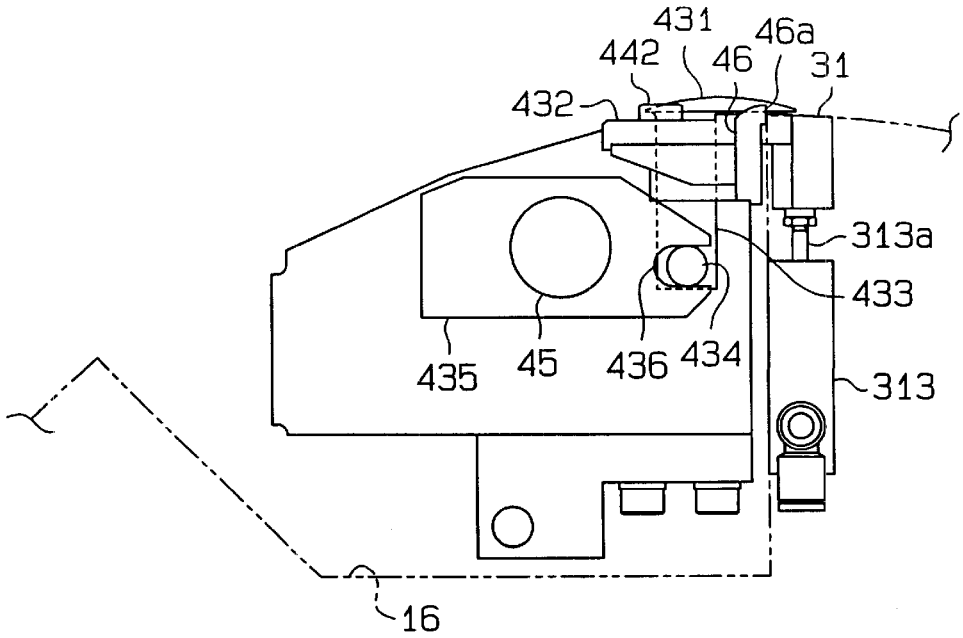
FIG. 5A is a side view showing a holder and a first base when a thick paper is transferred.
Figure 5B:
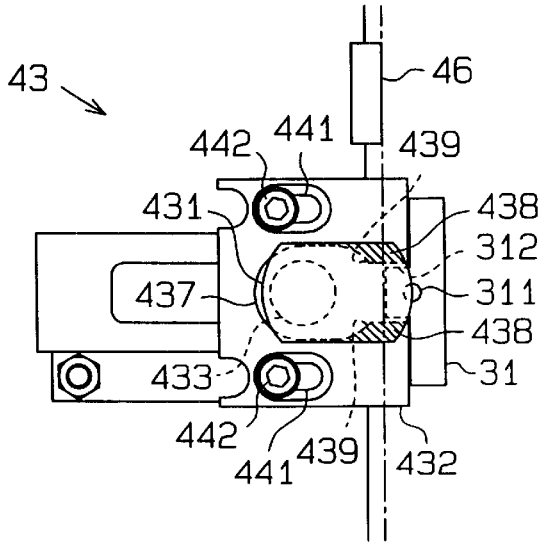
FIG. 5B is a plan view showing the holder and the first base of FIG. 5A.
Figure 6A:
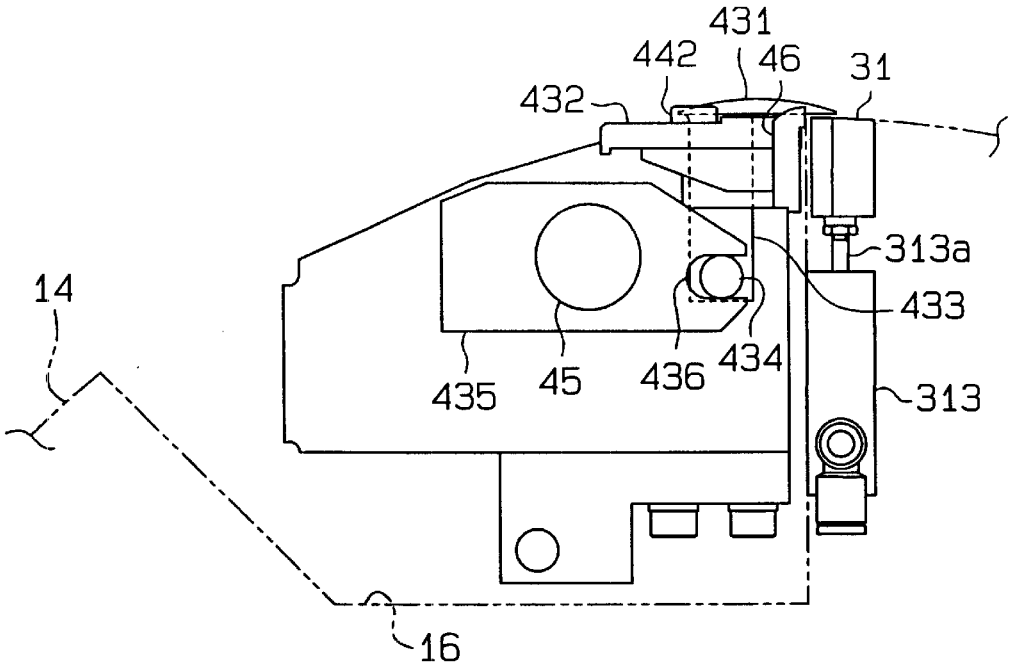
FIG. 6A is a side view showing the holder and the first base when a thin paper is transferred.

As shown in FIG. 4, the second gripper unit 40 is arranged in the groove 16 of the printing cylinder 14. The second gripper unit 40 has a plurality of holders 43. When the second gripper unit 40 is in the holding position, each of the holders 43 is adjacent to an associated one of the first bases 31. More specifically, as shown in FIGS. 5A and 5B, the second gripper unit 40 includes a second base 432 that contacts the first base 31. As shown in FIG. 5B, each first base 31 has a projection 312, which extends in the clockwise direction of the printing cylinder 14 as viewed FIG. 1, and a round small hole 311. As shown in FIGS. 5A and 6A, the small hole 311 receives a piston rod 313*a* that is driven by an air cylinder 313.

The piston rod 313*a* is normally received in the small hole 311. When the air cylinder 313 lifts the piston rod 313*a*, the top end of the piston rod 313*a* extends out of the small hole 311 from the upper surface of the first base 31. When the printing cylinder 14 is rotated by a predetermined angle, the air cylinder 313 lifts the piston rod 313*a*. A limit switch (not shown) detects the rotational angle of the printing cylinder 14. The limit switch is actuated when the printing cylinder 14 is rotated by a predetermined angle. Further, the limit switch is arranged so that it is actuated and de-actuated in relation with the position of the stripper plate 27 and in synchronism with the rotation of the printing cylinder 14.

Each of the suction members 32 has a plurality of suction holes 321 that are arranged in two rows along the longitudinal axis. The suction holes 321 are connected to a suction pump (not shown) by an air tube (not shown). When the suction pump is operated, the sheet P is drawn toward the suction holes 321. When the sheet P is transferred to the first gripper unit 30, the suction pump is operated and the sheet P is drawn to the suction holes 321 (suction members 32). Thus, the first gripper unit 30 holds the sheet P. A limit switch (not shown) starts and stops operation of the suction pump in synchronism with the rotation of the printing cylinder 14.

Figure 3:
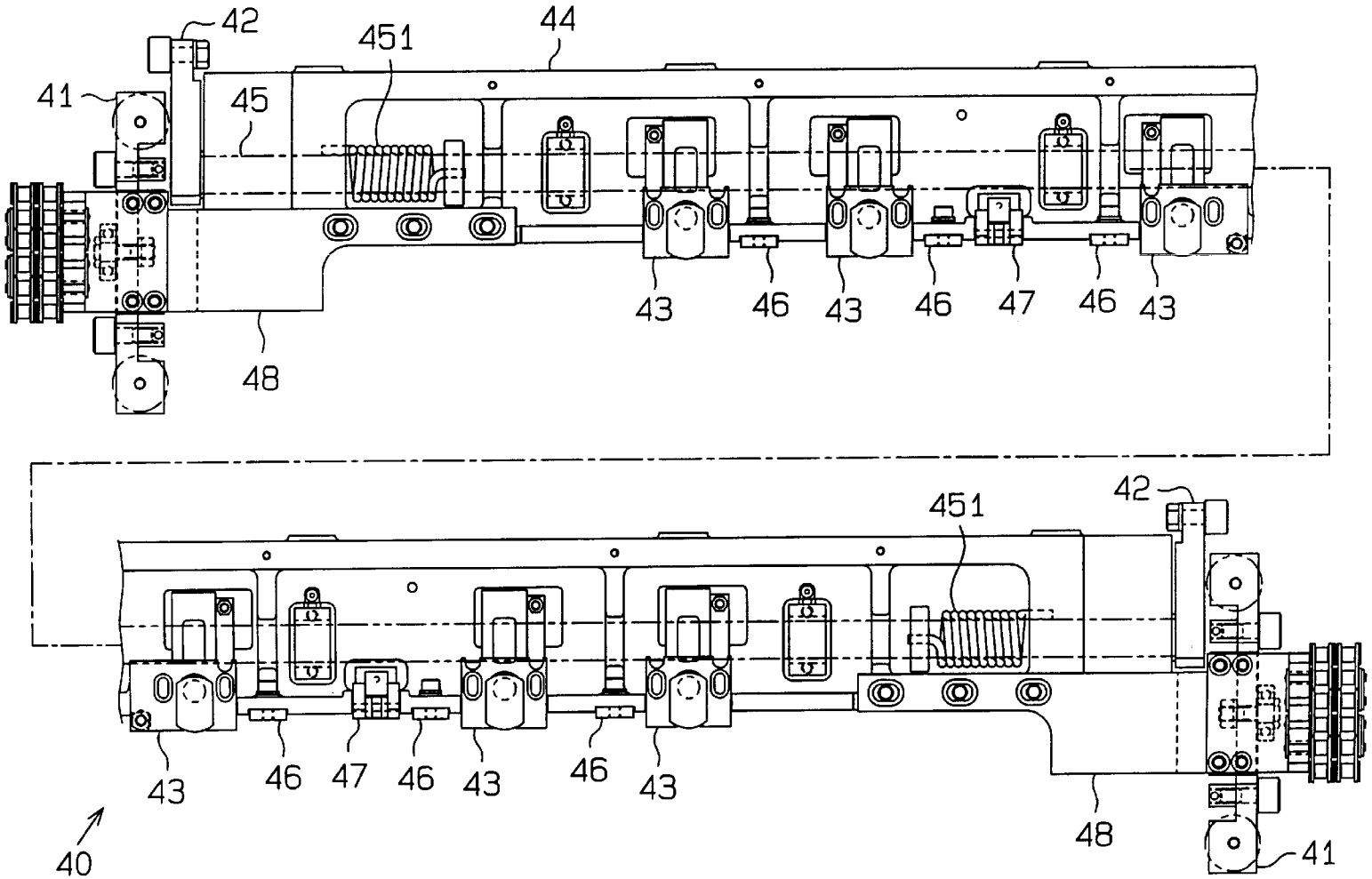
FIG. 3 is a plan view showing a second gripper unit.

The second gripper unit 40 will now be discussed. As shown in FIG. 3, the second gripper unit 40 has a case 44, a shaft 45 covered by the case 44, two levers 42 fixed to the shaft 45, two supports 48 respectively fixed to the two ends of the case 44, two sliders 41 supported by the supports 48, a plurality of sheet stoppers 46, a plurality of holder 43, and two separators 47.

The case 44 extends in the axial direction of the printing cylinder 14. The holders 43 and the sheet stoppers 46 are arranged with predetermined intervals in between and are fixed to the upper surface of the case 44. The two separators 47 are fixed to the longitudinal ends of the case 44.

The shaft 45 is rotatably supported by the case 44. The ends of the shaft 45 extend out the case 44. The two levers 42 are each fixed to one end of the shaft 45. The distal end of each support 48 is located on the outer side the associated end of the case 44. Each slider 41 is fixed to the distal end of each support 48.

Figure 6B:
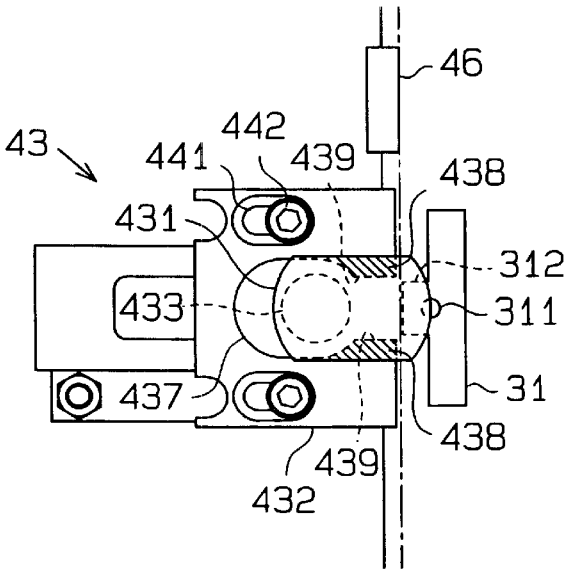
FIG. 6B is a plan view showing the holder and the first base of FIG. 6A.

As shown in FIGS. 5B and 6B, each holder 43 is formed by a gripper 431 and a second base 432, which is arranged under the gripper 431. The gripper 431 has two parallel sides and two outwardly extending arcuate sides. The distance between the two arcuate sides is longer than the distance between the two parallel sides. In other words, the gripper 431 is a tonneau-shaped plate. As shown in FIGS. 5A and 6A, the gripper 431 has a convex upper surface and a flat bottom surface. A link rod 433 extends downward from the bottom surface of the gripper 431. A pin 434, which extends parallel to the axial direction of the printing cylinder 14, is formed on the lower end of the link rod 433.

A plurality of connecting plates 435 are fixed to the shaft 45 in association with the holders 43. When the shaft 45 is rotated, the connecting plates 435 are rotated integrally with the shaft 45. Each of the connecting plates 435 has a U-shaped notch 436. The pin 434 of the corresponding link rod 433 is engaged with the notch 436. A predetermined clearance is provided between the pin 434 and the notch 436. The rotation of each connecting plate 435 is converted to the axial movement of the link rod 433 by the pin 434. Therefore, the rotation of the shaft 45 lifts the grippers 431. Normally, the grippers 431 are urged downward to a closed position by coil spring 451, which are wound around the shaft 45 (refer to FIG. 3).

As shown in FIGS. 5B and 6B, each U-shaped second base 432 has two elongated engaging holes 441, which extend parallel to each other. The second base 432 is fixed to the case 44 by two bolts 442, which are inserted through the two engaging holes 441. The second base 432 slides along the engaging holes 441 when the bolts 442 are loosened. The second base 432 is arranged at a first position, which is shown in the state of FIG. 5B, to print a relatively thick sheet P. Further, the second base 432 is arranged at the second position, which is shown in the state of FIG. 6B to print a relatively thin sheet P. That is, the position of the second base 432 is shifted in accordance with the thickness of the sheet P.

The second base 432 has a notch 437 opened toward the first base 31. The notch 437 prevents interference between the second base 432 and the link rod 433. The second base 432 has two extensions 439, which define the ends of the notch 437. The two extensions 439 face each other with a predetermined space in between. As shown in FIG. 5B, the projection 312 of the first base 31 is arranged between the extensions 439. A predetermined clearance is provided between the projection 312 and the extensions 439. When the gripper 431 is in the closed position, the bottom surface of the gripper 431 contacts the upper surface of the two extensions 439. A gripping portion 438, which serves as a second holding portion (the parts shown with the slanted lines in FIGS. 5B and 6B), is defined by the bottom surface of the gripper 431 and the upper surface of the two extensions 439.

The sheet stoppers 46 will now be explained referring FIG. 5A and FIG. 6A. Each sheet stopper 46 positions the sheet P transferred from the upstream of the printing mechanism 10. More particularly, the sheet stopper 46 has a positioning surface 46*a*. The positioning surface 46*a* is arranged so that its middle portion is substantially aligned with the upper surfaces of the second bases 432 and the bottom surfaces of the grippers 431. In other words, the sheet P transferred along the surface of the printing cylinder 14 is positioned along the upper surfaces of the second bases 432 or the bottom surfaces of the grippers 431 when contacting the positioning surface 46*a*.

When the second bases 432 are located at the first position (FIG. 5B), the upstream end surface of each second base 432 is upstream of the positioning surface 46*a* of the sheet stopper 46. In printing, the sheet P contacts the sheet stopper 46 and the sheet P is in the position shown by the dashed line in FIG. 5B. In this position, the sheet P is positioned between the upper surface of the second bases 432 and the bottom surface of the grippers 431. When the gripper 431 moves to the lower position, the sheet P is held by the second base 432 and the gripper 431.

When the second bases 432 are located at the second position (FIG. 6B), the upstream end surface of each second base 432 is downstream of the positioning surface 46*a* of the sheet stopper 46. During a printing operation, the sheet P contacts the sheet stopper 46 and is positioned as shown by the broken line in FIG. 6B. At this position, the sheet P is not arranged between the upper surfaces of the second bases 432 and the bottom surfaces of the grippers 431. In other words, the gripping portions 438 are downstream of the distal end of the sheet P. Therefore, the gripping portions 438 do not hold the sheet P.

Figure 8A:
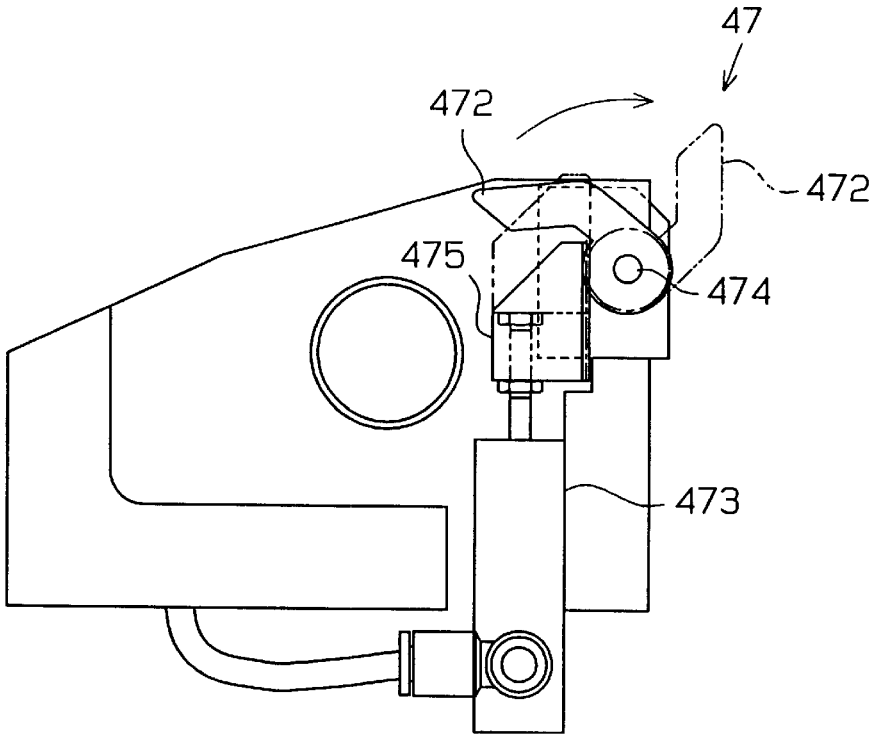
FIG. 8A is a side view showing a remover of the second gripper unit.
Figure 8B:
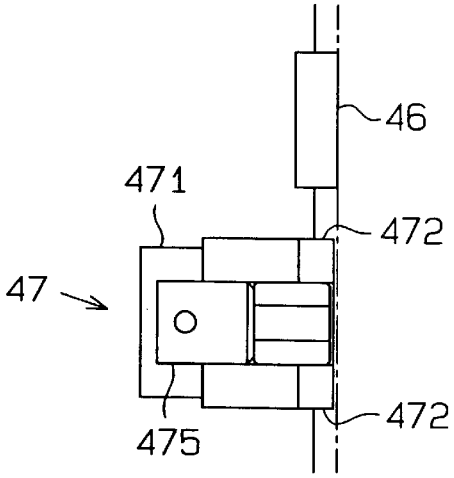
FIG. 8B is a plan view showing the remover of FIG. 8A.

The separators 47 will now be explained referring to FIGS. 3, 8A, and 8B. Each separator 47 includes a main body 471, two arms 472, and an arm actuator 473. As shown in FIG. 8A, each arm 472 is bent and has a disk-like basal end. A rotation shaft 474 connects the basal ends of the two arms 472. The arm actuator 473 has a head 475, which contacts the basal ends of the two arms 472. The head 475, which contacts the basal ends of the arms 472, is moved axially by the arm actuator 473. Normally, the head 475 and the arms 472 are in a retracted position as shown by the solid line in FIG. 8A. When the arm actuator 473 is driven, the head 475 pivots the arm 472 about the rotation shaft 474 in the direction indicated by the arrow. This moves the head 475 and the arm 472 to a lifted position, as shown by the broken lines. When the second gripper unit 40 contacts a limit switch 262 (refer to FIG. 9), which is arranged on the discharging rail 25, the arm actuator 473 is actuated to move the arm 472 to the lifted position.

Figure 7A:
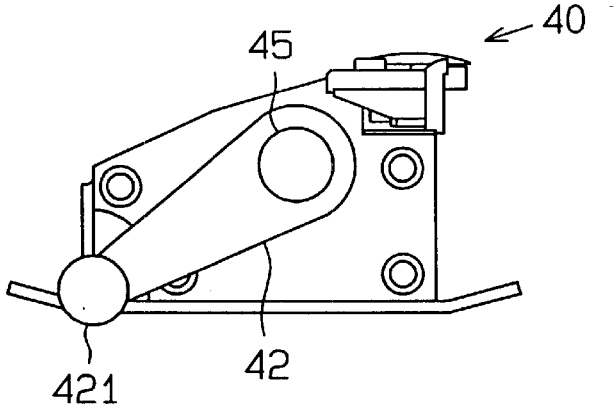
FIG. 7A is a side view showing a lever of a second gripper unit.

As shown in FIG. 7A, each lever 42 has a basal end fixed to the shaft 45 and a distal end to which a roller 421 is coupled. The coil springs 451 urge the distal end of the lever 42 in a downward direction (the counterclockwise direction as viewed in FIG. 7A). When the lever 42 receives an upward force greater than the urging force of the coil spring 451, the lever 42 and the shaft 45 are rotated in an upward direction (the clockwise direction as viewed in FIG. 7A). Accordingly, the grippers 431 are opened and closed by the pivoting of the lever 42.

Figure 9:
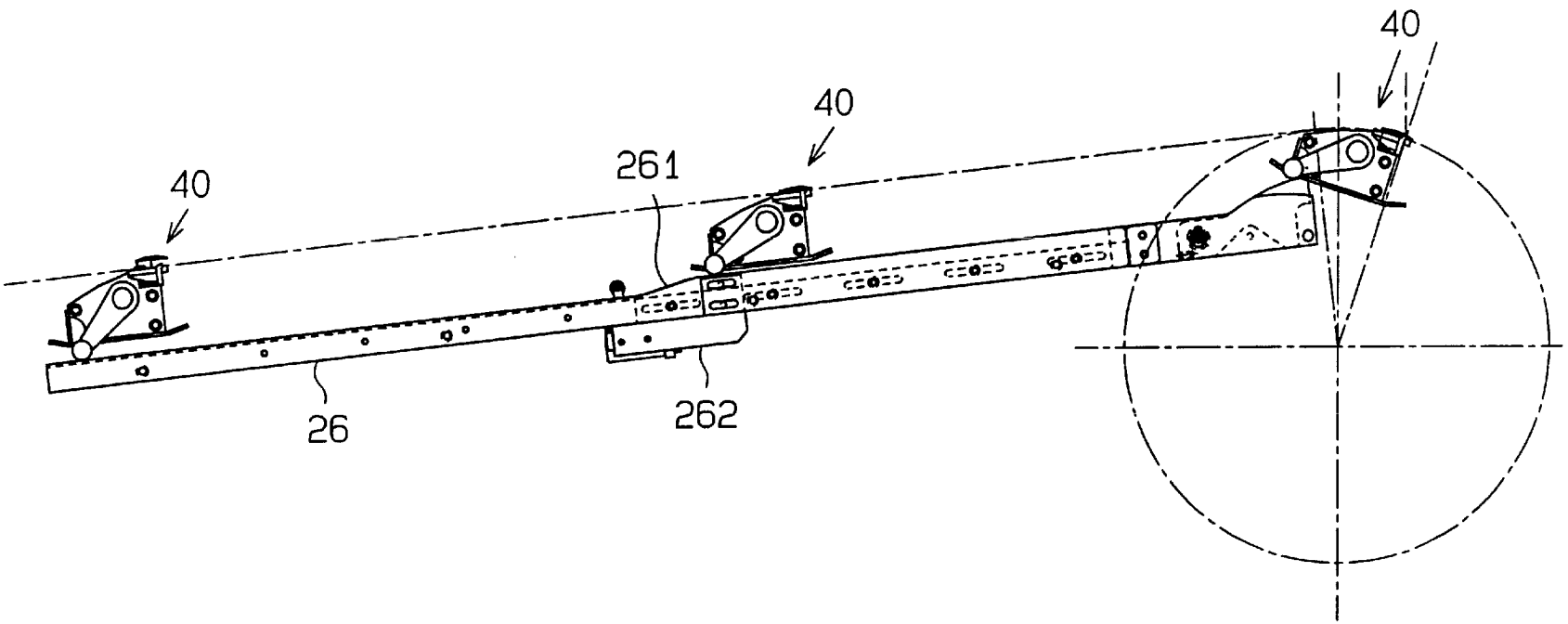
FIG. 9 is a side view showing the second gripper unit moving along a guide rail.

Referring to FIG. 9, the gripper unit 40 moves along the discharging rails 25. During the movement of the gripper unit 40, the rollers 421 contact the uneven upper surfaces of the guide rails 26. The lever 42 is pivoted in accordance with the uneven surfaces of the guide rails 26. Therefore, the gripper 431 is opened and closed by the uneven guide rails 26.

Figure 7B:
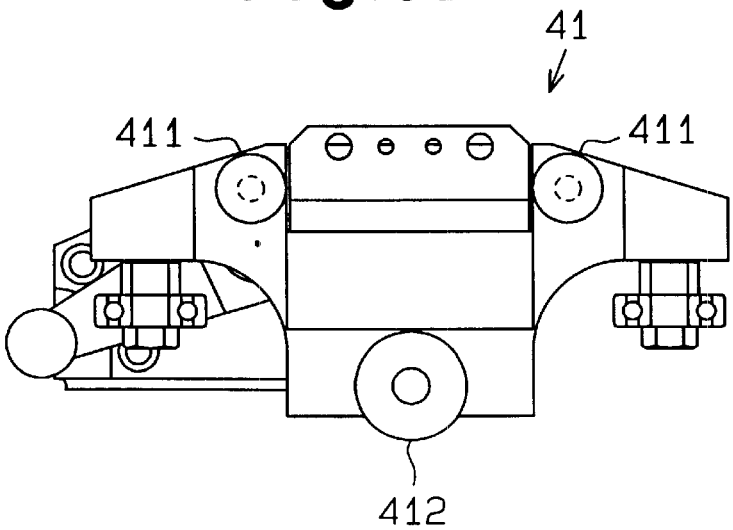
FIG. 7B is a side view showing a slider of the second gripper unit.
Figure 10:
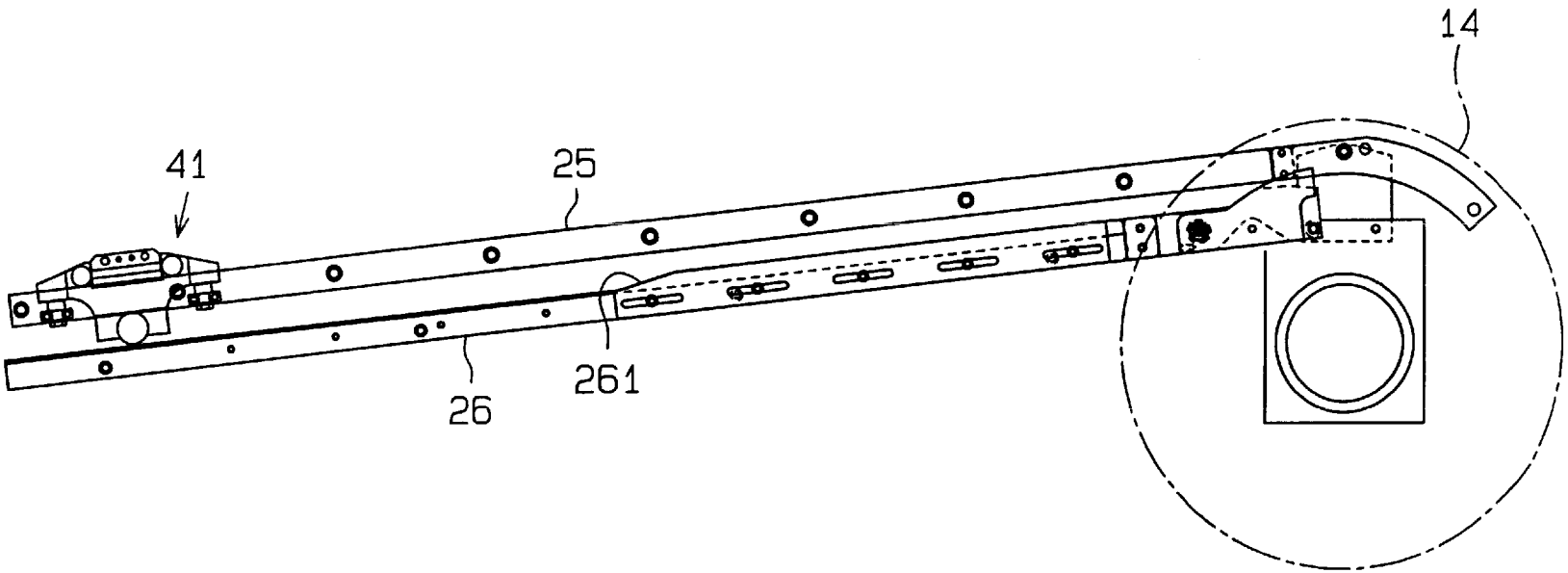
FIG. 10 is a side view showing a slider that moves along a paper discharging rail.

FIG. 7B is a side view showing the slider 41. Each slider 41 has two upper wheels 411 and a lower wheel 412. As shown in FIG. 10, each slider 41 is connected to one of the discharging rails 25 so that the discharging rail 25 is held between the upper wheels 411 and the lower wheel 412. Therefore, the sliders 41 are movable along the two discharging rails 25 and enable the second gripper unit 40 to move between the holding position and the second paper discharging position.

The discharging rails 25 and the guide rails 26 will be explained with reference to FIGS. 9 and 10. The two discharging rails 25 are arranged at the axial ends of the printing cylinder 14. Each discharging rail 25 is inclined at a predetermined angle from the upstream (the holding position or the print start position) to the downstream (the second paper discharging position). The arcuate upstream end of each discharging rail 25 and the printing cylinder 14 are concentric.

The two guide rails 26 are substantially parallel to the two discharging rails 25. Accordingly, the two guide rails 26 are arranged at the axial ends of the printing cylinder 14. The upstream end of each guide rail 26 rises gradually toward the discharging rail 25. As the second gripper unit 40 approaches the upstream end of the rails 25, 26, the posture of the second gripper unit 40 is changed in accordance with the arcuate shape of the discharging rails 25. Thus, the guide rails 26 shift the positions of the levers 42.

A tapered portion 261, which alters the height of the upper surface of the guide rail 26, is defined in the longitudinally middle part of each guide rail 26. Although the tapered portion 261 is located at a predetermined position on each guide rail 26, the location of the tapered portion 261 may be changed as required. As shown in FIG. 9, the limit switch 262 is attached to one of the guide rails 26 (the guide rail 26 located on the left side relative to the downstream direction in the preferred embodiment). The limit switch 262 detects the passage of the second gripper unit 40 and rotates the separator 47 to the lifted position.

The discharging operation of the printed sheet P will be explained.

(A) When the Sheet P is Relatively Thick (Rigid)

The second bases 432 of the second gripper unit 40 are positioned in the first position. When the groove 16 is positioned at substantially the top of the printing cylinder 14, the second gripper unit 40 is arranged in the groove 16. As shown in FIG. 5A, each second base 432 contacts the associated first base 31 and the bottom surface of the second base 432 is substantially aligned with the upper surface of the first base 31.

As shown in FIG. 5B, when the second gripper unit 40 is arranged in the holding position, the projection 312 of each first base 31 is accommodated in the notch 437 of the associated second base 432. The gripper 431 is spaced from the second base 432 by a predetermined distance.

The sheet P, which is supplied from the transferring device 20, is positioned when contacting the sheet stopper 46. At this time, the sheet P is inserted between the gripper 431 and the second base 432. The second gripper unit 40 moves along the arcuate discharging rails in synchronism with the counterclockwise rotation of the printing cylinder 14. In other words, the gripper unit 40 is rotated in the same phase as the printing cylinder 14. Therefore, contact between the second base 432 and the first base 31 is maintained.

When the second gripper unit 40 starts to move, the levers 42 contact the upper surface of the guide rail 26. In this state, the high position of the guide rails 26 lifts the levers 42. This lowers each gripper 431 to the closed position where the gripper 431 contacts the second base 432 and the gripping portion 438 of the associated holder 43 holds the sheet P.

When the printing cylinder 14 is further rotated and the gripper unit 40 reaches the lower linear portion of the discharging rails 25, the second gripper unit 40 is separated from the groove 16. Further, the second gripper unit 40 removes the sheet P from the printing cylinder 14. The screen frame 11 moves in synchronism with the rotation of the printing cylinder 14. This presses the printing plate 15 against the sheet P and performs printing on the sheet P.

As the second gripper unit 40 moves along the discharging rails 25 and reaches the tapered portions 261, the levers 42 are pivoted downward (in the counterclockwise direction) along the tapered portions 261. This rotates the shaft 45 of the second gripper unit 40 and lifts the gripper 431 to the open position by means of the connecting plate 435 and the link rod 433. Thus, the holders 43 release the sheet P.

Further, when the second gripper unit 40 passes the limit switch 262, each arm actuator 473 positions the associated arm 472 to the lifted position. This releases the sheet P from the holder 43 and drops the sheet P into the thick paper tray 211, which is located under the guide rail 26.

After the discharging, the second gripper unit 40 is moved to the upstream side and returned to its original position (the holding position), and the printing cylinder 14 is rotated in the counterclockwise direction and returned to its original position (the print start position).

(B) When the Sheet P is Relatively Thin (Flexible)

The second base 432 is positioned in the second position. In the same manner as case (A), when the groove 16 is positioned at substantially the top portion of the printing cylinder 14, the second gripper unit 40 is arranged in the groove 16. As shown in FIG. 6A, each second base 432 contacts the associated first base 31, and the bottom surface of the second base 432 is flush with the upper surface of the first base 31.

As shown in FIG. 6B, when the second gripper unit 40 is in the holding position, the first base 31 is separated from the second base 432 and the projection 312 of the first base 31 is not accommodated in the notch 437 of the second base 432. Each gripper 431 is separated from the second base 432 by a predetermined distance.

The sheet P, which is supplied from the transferring device 20, is positioned when contacting the sheet stopper 46. Since each second base 432 is positioned downstream of the sheet stoppers 46, the front end of the sheet P does not reach the second base 432. In other words, the gripping portion 438 is not overlapped with the sheet P. Therefore, the sheet P is not inserted between the grippers 431 and the second bases 432, and the holders 43 do not hold the sheet P.

The gripper unit 40 moves along the arcuate discharging rails 25 in synchronism with the counterclockwise rotation of the printing cylinder 14. The suction pump is operated in synchronism with the rotation of the cylinder 14. This draws the sheet P to the suction holes 321 of the first gripper unit 30.

When the printing cylinder 14 is further rotated and the gripper unit 40 reaches the lower linear portion of the discharging rails 25, the second gripper unit 40 is removed from the groove 16. However, the second gripper unit 40 moves without the sheet P. The sheet P is held by the first gripper unit 30 and rotated integrally with the printing cylinder 14. The screen frame 11 is moved in synchronism with the rotation of the printing cylinder 14. This presses the printing plate 15 against the sheet P and performs printing on the sheet P.

When the printing cylinder 14 is rotated by a predetermined angle, the suction pump stops operating. Simultaneously, the air cylinder 313 of each first base 31 lifts the associated piston rod 313*a*. The top end of the lifted piston rod 313*a* extends from the small hole 311 of the first base 31. As a result, the sheet P, which is supported by the first bases 31, is released from the first gripper unit 30. The released sheet P is guided by the stripper plate 27 and transferred to the thin paper tray 221.

After the sheet P is released, the printing cylinder 14 is rotated in the clockwise direction and returned to its original position (the print start position). The second gripper unit 40 also returns to its original position (the holding position).

The following advantages are obtained in the cylinder type screen printing machine 1 of the preferred embodiment.

(1) The first gripper unit 30 or the second gripper unit 40 selectively holds a sheet P in accordance with the position of the second base 432. Therefore, the paper discharging apparatus discharge sheets P of different thickness merely by changing the position of the second base 432 in accordance with the thickness of the sheet P.

(2) Each second base 432 is fixed to the case 44 by a bolt 442. Therefore, the position of the second base 432 is easily adjusted by loosening the bolt 442.

(3) The gripper unit 30 draws only relatively thin sheets P. Therefore, the suction pump need only a relatively weak suction force to draw the sheet P to the first gripper unit 30.

(4) The second gripper unit 40 releases the held sheet P in accordance with the level of the upper surface of the guide rail 26. Therefore, the position of the tapered portion 261 may be shifted to change the holding release position.

(5) The first gripper unit 30 releases the sheet P with the air cylinders 313 and their piston rods 313*a*. The relatively simple mechanism of the air cylinder 313 and the piston rod 313*a* ensures the operation for releasing the sheet P.

(6) The limit switch 262 operates the arm actuator 473 of each separator 47. The relatively simple mechanism of the arm actuators 473 and their arms 472 ensures the releasing of the sheet P from the second gripper unit 40.

(7) The first gripper unit 30 is fixed to the printing cylinder 14. Thus, a mechanism for moving the first gripper unit 30 relative to the cylinder 14 is not necessary. Accordingly, the sheet P is discharged from the first gripper unit 30 in a stable and inexpensive manner.

(8) When the first gripper unit 30 and the second gripper unit 40 are arranged in the groove 16, the upper surface of each first base 31 is flush with the upper surface of the associated second base 432. The upper surface of the first base 31 and the upper surface of the second base 432 guide the sheet P to a predetermined position. This ensures that the sheet P be held.

(9) A relatively rigid sheet P is transferred in the tangential direction of the cylinder 14 by the second gripper unit 40. This prevents the printing plate 15 from being damaged by the sheet P.

(10) A relatively thin sheet P is transferred along the surface of the cylinder 14 by the first gripper unit 30. This facilitates the separation of the sheet P from the printing plate 15. Accordingly, printing is not interrupted.

It should be apparent to those skilled in the art that the present invention may be embodied in many other specific forms without departing from the spirit or scope of the invention. Particularly, it should be understood that the present invention may be embodied in the following forms.

The shape of the first base 31, the gripper 431, and the second base 432 is not limited to the shapes described in the above embodiment. Further, the second bases 432 do not have to be moved horizontally. For example, the second base 432 may be rotated by 90 degree along a horizontal plane to change the distance between each first base 31 and the upstream end surface of associated the second base 432.

The grippers 431 are lifted by the rotation of the shaft 45, which cooperates with the pivoting of the levers 42. However, for example, the grippers 431 may be lifted by other mechanisms such as an air cylinder.

The locations of the tapered portion 261 and the limit switch 262 may be changed. This would change the holding release position of the grippers 431 and the operation position of the arms 472.

The depth and the width of the groove 16 may be altered. Further, the inclination of the walls of the groove 16 may be changed.

Instead of the piston rod 313*a*, the sheet P may be released by ejecting air from the small hole 311. In this case, part of the suction mechanism (the pump or pipes) of the suction member 32 may be used to eject air.

The present examples and embodiments are to be considered as illustrative and not restrictive, and the invention is not to be limited to the details given herein, but may be modified within the scope and equivalence of the appended claims.

What is claimed is:

1. A paper discharging apparatus provided in a screen printing machine, wherein the screen printing machine includes a rotatable printing cylinder for guiding a printed sheet of paper to one of a first discharging position and a second discharging position, the paper discharging apparatus comprising:

a first gripper unit for receiving the sheet at a predetermined holding position and transferring the sheet to the first discharging position;

a first holding portion defined in the first gripper unit for holding the sheet;

a second gripper unit for receiving the sheet at the holding position and transferring the sheet to the second discharging position, wherein the second gripper unit is adjacent to the first gripper unit at the holding position; and a second holding portion defined in the second gripper unit for holding the sheet, wherein the position of the second holding portion is selectively shifted between a first position and a second position relative to the second gripper unit, the second holding portion being allowed to hold the sheet when the second holding portion is in the first position, and the first holding portion being allowed to hold the sheet when the second holding portion is in the second position.

2. The paper discharging apparatus according to claim 1, wherein the first gripper unit is fixed to the printing cylinder to rotate integrally with the printing cylinder, and the second gripper unit moves reciprocally between the holding position and the second discharging position in synchronism with the rotation of the printing cylinder.

3. The paper discharging apparatus according to claim 1, wherein the first holding portion includes a suction portion defined in the first gripper unit for drawing the sheet.

4. The paper discharging apparatus according to claim 1, wherein the second holding portion includes a gripper and a base, which engages the gripper.

5. The paper discharging apparatus according to claim 4, wherein the position of the base is adjusted between the first position and the second position in accordance with the thickness of the sheet.

6. The paper discharging apparatus according to claim 1, wherein the second gripper unit has a stopper including a positioning surface for contacting an end of the sheet and positioning the sheet.

7. A paper discharging apparatus provided in a screen printing machine for receiving a sheet transferred from an upstream location and transferring the sheet to one of a first tray and a second tray in accordance with the thickness of the sheet, wherein the screen printing machine includes a printing cylinder reciprocally rotated between a print start position and a print end position, the paper discharging apparatus comprising:

a first gripper unit fixed in a groove extending axially along a cylindrical surface of the printing cylinder, wherein the first gripper unit receives the sheet when the printing cylinder is arranged at the print start position and releases the sheet when the printing cylinder is arranged at the print end position and the first gripper unit is adjacent to the first tray;

a first holding portion defined in the first gripper unit for holding the sheet;

a second gripper unit for moving in synchronism with the printing cylinder, wherein the second gripper unit is arranged in the groove adjacent to the first gripper unit when the printing cylinder is in the print start position and arranged adjacent to the second tray to release the sheet when the printing cylinder is in the print end position;

a stopper provided in the second gripper unit and having a positioning surface, wherein the positioning surface contacts a front end of the sheet to position the sheet; and a second holding portion defined in the second gripper unit to hold the sheet, wherein the second holding portion includes:

a base selectively shifted between a first position and a second position relative to the second gripper unit; and a gripper for holding the sheet with the base;

wherein the positioning surface is downstream of the base, and the gripper and the base hold the sheet when the base is in the first position, and the positioning surface is upstream of the base, and the first holding portion holds the sheet when the base is in the second position.

8. The paper discharging apparatus according to claim 7, wherein the sheet is one of a relatively thin paper and a relatively thick paper, and the base is arranged at the first position when the sheet is a relatively thick paper, and the base is arranged at the second position when the sheet is a relatively thin paper.

9. The paper discharging apparatus according to claim 8, wherein the first holding portion has a plurality of suction holes adapted to be connected to a suction pump that is operated when the base is in the second position, and the sheet is drawn to the plurality of suction holes.

10. The paper discharging apparatus according to claim 7, wherein the base has an elongated groove extending perpendicular to the positioning surface, and the second gripper unit has a bolt inserted in the elongated groove, and wherein the bolt is loosened to move the base between the first position or the second position.

* * * * *